US005277630A

United States Patent [19]

Clark

[11] Patent Number: 5,277,630

[45] Date of Patent: Jan. 11, 1994

[54] TROLLING MOTOR

[76] Inventor: James F. Clark, Rte. 4, Box 300, King George, Va. 22485

[21] Appl. No.: 15,903

[22] Filed: Feb. 10, 1993

[51] Int. Cl.[5] ..... B63H 5/12

[52] U.S. Cl. ..... 440/6; 440/60; 248/682

[58] Field of Search ..... 440/6, 7, 58-60; 248/640-642

[56] References Cited

U.S. PATENT DOCUMENTS

| | | | |
|---|---|---|---|
| 3,930,461 | 1/1976 | Brock et al. | 248/642 |
| 3,980,039 | 9/1976 | Henning | 440/6 |
| 4,668,195 | 5/1987 | Smith | 440/6 |
| 4,708,670 | 11/1987 | Peters | 248/642 |
| 4,734,066 | 3/1988 | Burgess | 440/6 |

*Primary Examiner*—Jesus D. Sotelo
*Attorney, Agent, or Firm*—Harold H. Dutton, Jr.

[57] ABSTRACT

An auxiliary outboard motor for boats comprising an electric propulsion motor having a propeller, a supporting shaft therefor with a first rack gear mounted thereon, a device for mounting the supporting shaft onto a boat, the mounting device comprising a primary mounting bracket for fastening to a boat and having a second rack gear secured thereto, a secondary mounting bracket pivotally connected to the primary bracket, the secondary mounting bracket comprising a housing having a bearing for supporting the supporting shaft for longitudinal movement with respect to the secondary mounting bracket, a reversible electric drive motor housed in the secondary bracket, and including a device for drivingly engaging the first and second rack gears for moving the supporting shaft longitudinally with respect to the secondary bracket and for pivoting the secondary bracket relative to the primary bracket for moving the supporting shaft between an operative position and a stowed position, and a device for disengaging said electric drive motor after a predetermined longitudinal travel of the supporting shaft.

15 Claims, 5 Drawing Sheets

TROLLING MOTOR

This invention relates to an improved electric motor for use on boats, and particularly fishing boats. More particularly, the invention relates to an electric outboard motor of the type commonly known as a "trolling motor" having an improved system for moving the boat propulsion motor between a stowed position and an operational position.

BACKGROUND AND OBJECTS OF THE INVENTION

A great number of electric outboard motors are in common use for propelling boats, particularly fishing boats. Such motors have the great advantage of being quiet and highly maneuverable, even when mounted on large boats, and for these reasons, are often used as auxiliary motors on fishing boats. Generally, fishing boats use a large gasoline powered engine mounted on the rear of the boat for moving the boat greater distances and/or at relatively high speeds. But such motors internal combustion engines are relatively noisy, and because of their size have reduced maneuverability when the boat is simply to be moved slowly and/or for short distances, or quietly while the user is fishing.

Such fishing boats typically have an electric auxiliary motor which is used while the boaters are fishing. These electric motors are frequently mounted by being clamped onto the transom of the boat and operable by a person sitting in the rear of the boat, or by a special mounting bracket secured on the bow of the boat and operable by a fisherman using the front fishing platform of the boat. In either case, the electric motor has a support shaft which is essentially vertically disposed with respect to the surface of the water, and an electric motor mounted on one end of the shaft. The motor is generally at right angles to the support shaft, and the support shaft houses electric wires for powering the motor. A propeller is mounted on one end of the motor shaft.

The support shaft is commonly secured to a mounting bracket which is attached to a suitable surface on the boat, such as a deck surface or the transom. When in the vertical, operational position, the support shaft is allowed to rotate in the housing in order that the thrust of the motor may be directed in the desired direction for steering the boat.

Generally, the steering is accomplished either by a foot operated pedal connected to a rack and pinion connection by a cable which causes rotation of the supporting shaft, or else is rotated by hand by means of a suitable handle extending orthogonally to the shaft, so that movement of the handle from side to side (actually an arcuate movement) causes rotation of the shaft for changing the direction of thrust and steering the boat.

A number of different bracket systems have been developed and marketed for attaching the motor to the boat, and these brackets usually are required to permit the electric motor to be retracted into the boat when the motor is not in use, or lowered into the water for use. Generally, in the operational position, the supporting shaft is vertical, i.e. perpendicular to the water surface, while in the stowed position, the supporting shaft is horizontal or parallel to the water surface.

The simplest of such brackets simply utilize a pivot pin arrangement which allows the motor supporting shaft to pivot between its vertical position, with the electric motor in the water in an operational or use position, and a horizontal or stowed position, with the electric motor out of the water. Such brackets require an additional adjustment, in order to allow the motor to be positioned at a proper depth in the water when in use, and to be fully retracted into the boat when not in use.

More sophisticated brackets utilize a parallelogram type of linkage to connect the motor supporting shaft with the boat mounted bracket, and lock the shaft securely in place in either of the two positions. Such brackets, while still permitting adjustment of the depth of the motor in the water, do not require the adjustment after each use, but enable a better lowering and raising of the motor between the two positions.

A few prior brackets have provided a motorized raising and lowering of the motor between the operational position and the stowed position. For example U.S. Pat. No. 3,930,461 issued to Brock provided such a bracket which uses an additional electric motor driving a cable and pulley system to move the outboard motor between the stowed position and the working position.

Another patent, U.S. Pat. No. 4,708,670 issued to Peters provided another powered arrangement for raising and lowering the electric outboard, and had a separate electric motor driving a worm gear in engagement with a follower attached to the motor mounting shaft for raising and lowering the electric outboard.

In both of these prior systems, however, the operating elements, i.e. the cable and pulley of Brock or the worm and follower of Peters, are relatively large and bulky, and most of the elements are open and exposed. They are therefor likely to become tangled with fishing equipment, line or weeds, and also may be readily damaged by hard objects such as lures or equipment which become entangled therein, and prematurely worn by rain, sunlight, and other weather factors.

U.S. Pat. Nos. 4,734,066 to Burgess and 4,668,195 to Smith also use auxiliary motors to raise and lower the trolling motors, but only operate to raise the trolling motor in a purely vertical sense. In other words, there is no pivoting of the motor mounting shaft. Such arrangements would require significant modification of the boat for general use, and thus are not generally suited for accessory market trolling morots.

For a variety of reasons, none of the prior art motors which provided for a powered raising or lowering of the trolling motor has met with significant success. These prior art systems have been susceptible of malfunction or damage during use, thus decreasing the reliability of the mounting system. Since reliability is a very important factor in trolling motors, a very dependable system is needed in order for the bracket to achieve significant success in the field. Electric trolling motor mounting brackets are subject to very significant forces during normal use, including severe bouncing during high speed travel in a stowed position, as well as impact with underwater objects during use in an operating position.

Accordingly a primary object of the present invention is to provide an improved mounting system for electric trolling motors.

Another object of the invention is to provide an improved mounting system which enables a powered stowing or deploying of the trolling motor between a horizontal or stowed position and a vertical operating position.

A further object of the invention is to provide an improved mounting system in which the electric trolling motor is pivoted between a horizontal stowed position and a vertical operating position by means of a closed motor and gearing arrangement.

Still a further object of the invention is to provide an improved mounting system for electric trolling motors which overcomes the disadvantages of prior art mounts.

DESCRIPTION OF THE INVENTION

The present invention provides a trolling motor mounting system which is powered by a small electric positioning motor for moving the trolling motor between a horizontal, stowed position and a vertical operating position. In addition to pivoting the motor mounting shaft, the invention also raises and lowers the trolling motor vertically as the motor is moved between the stowed and operating positions. By the term "vertically" is meant a direction axially of the supporting shaft and perpendicular to the water surface. As is apparent, however, as the motor is tilted toward the stowed position, the "vertical" axis of movement inclines toward the horizontal.

The motor raising drive mechanism incorporates a unique drive system utilizing a motor driven worm gear cooperating with a slip clutch arrangement which positively drives the motor in both directions between the stowed and operational positions, and which also includes a release mechanism to release the arcuate rack drive engagement when the vertical operating position is reached. A cam arrangement is provided for rotating the motor supporting shaft as the unit is raised, in order that the motor housing returns to the same stowed position each time without binding.

The motor raising and lowering system according to the present invention is particularly well suited for use with existing steering systems which have the rack and pinion mechanism in the top or head portion of the unit.

The electric positioning motor has a worm gear on its output shaft, and the worm gear directly engages a pinion gear train mounted on a transfer shaft and engaging a rack gear mounted on the supporting shaft for raising and lowering the supporting shaft along its longitudinal axis. A second pinion gear is mounted on the transfer shaft and through a drive chain, powers a pinion gear in engagement with an arcuate rack gear. This arcuate track causes the supporting shaft to pivot about a horizontal axis, while the other pinion and linear rack raises the supporting shaft.

A spring biased shaft carrying a transverse clutch pin is mounted axially within the transfer shaft, and a threaded sleeve on the transfer shaft engages or releases the clutch pin at the limit of travel, in order to stop the arcuate movement of the supporting shaft at the predetermined position.

DESCRIPTION OF THE DRAWINGS

The invention will be described in greater detail with reference to the following description and claims, when taken together with the accompanying drawings showing by way of non-limiting example, one preferred embodiment of the invention, and in which:

DETAILED DESCRIPTION OF PREFERRED EMBODIMENTS

Figure 1:
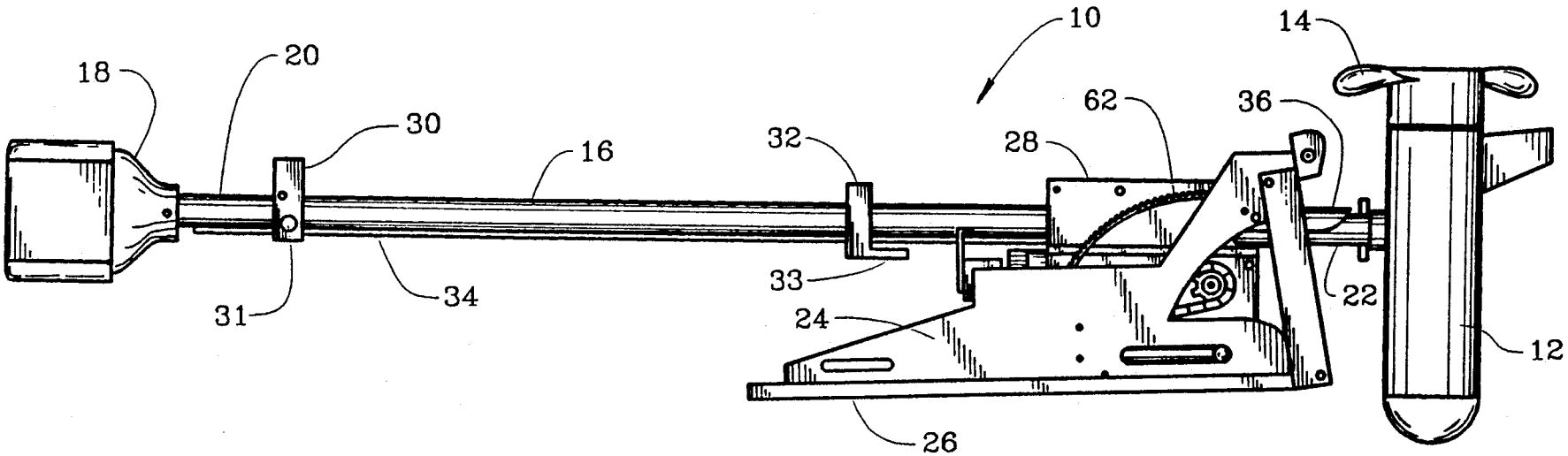
FIG. 1 is a side elevational view of a trolling motor according to the present invention in a stowed position.
Figure 2:
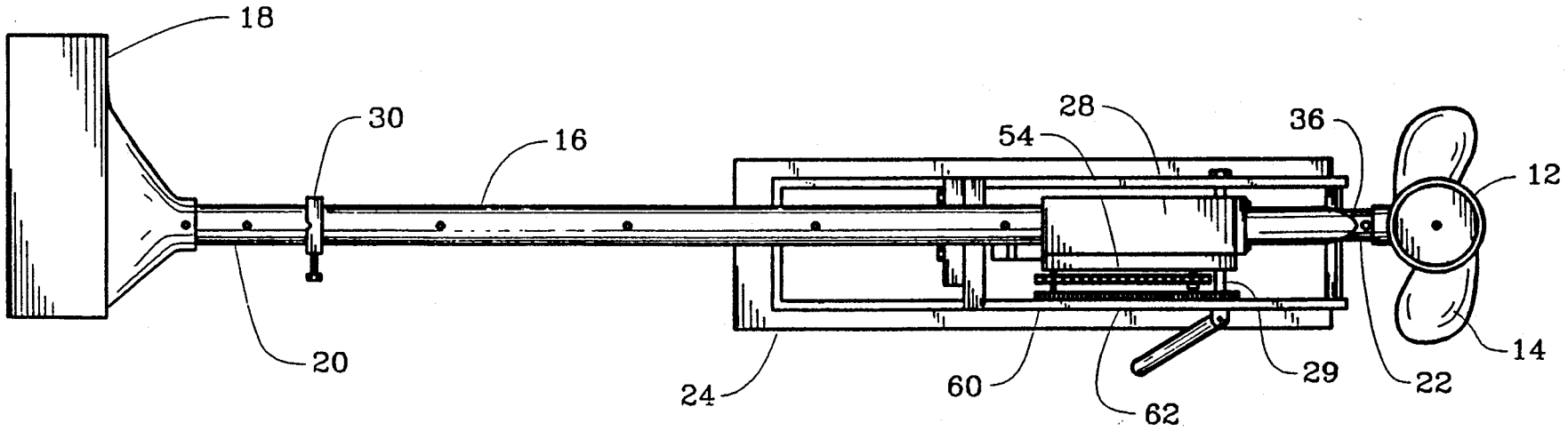
FIG. 2 is a top plan view of the trolling motor of FIG. 1.

Referring initially to FIGS. 1 and 2, the trolling motor 10 according to the present invention is seen to comprise an electric propulsion motor 12 with a propeller 14. The electric motor 12 is mounted at one end of a supporting shaft 16. At the other end of the supporting shaft 16 is the control head 18, which typically houses the steering mechanism. Frequently, the supporting shaft 16 is a pair of coaxial tubes 20 and 22, the outer of which 20 is secured in its angular position with respect to the head 18 but free to move vertically, and the inner of which is free to rotate about its longitudinal axis for steering with respect to, and inside the outer tube 20 which serves as a bushing.

A primary mounting bracket 24 has a mounting surface 26 which is bolted to the deck of a boat (not shown) in a conventional manner, and a secondary mounting bracket 28 mounts the supporting shaft 16 in the primary bracket 24. A pivot pin 29 connects the primary and secondary brackets to allow relative pivoting of the secondary bracket 28 relative to the primary bracket 24, and thus also relative to the deck of the boat upon which the bracket 24 is mounted.

An adjustable depth stop collar 30 is mounted on the supporting shaft 16 to limit the depth of the motor 12 in the water and includes a projecting pin 31 engageable with a slot 35 in the housing for securing the motor when in the lowered position. A sliding anti-kickback collar 32 is also mounted on the shaft 16, and includes a depending tang 33 which engages bracket 24 to prevent the thrust of the motor 12 from pivoting the bracket assembly when the motor thrust is reversed. A linear rack gear 34 is mounted to the outer tube 20 of the shaft 16.

The secondary bracket 28 is provided with a projecting cam 36 which serves to rotate the inner tube 22 of the supporting shaft 16 when the motor is raised toward the stowed position. This cam cooperates with a pin 40 projecting from a collar mounted on the shaft 16 as is shown in greater detail in FIGS. 4 and 5.

Figure 4:
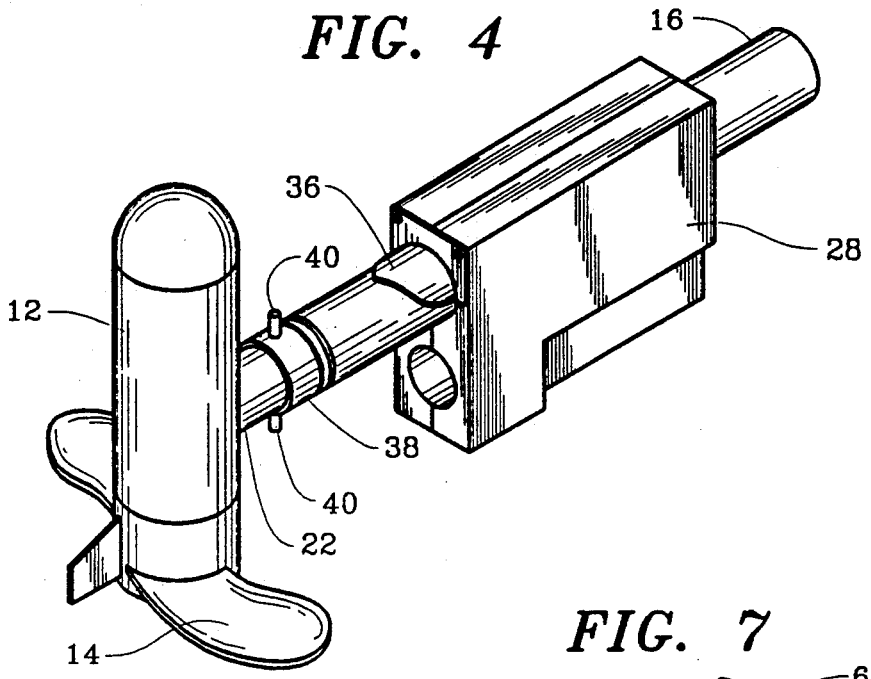
FIGS. 4 and 5 are perspective views of a portion of the trolling motor mount showing the mechanism for rotating the motor shaft to the proper position upon stowing.
Figure 5:
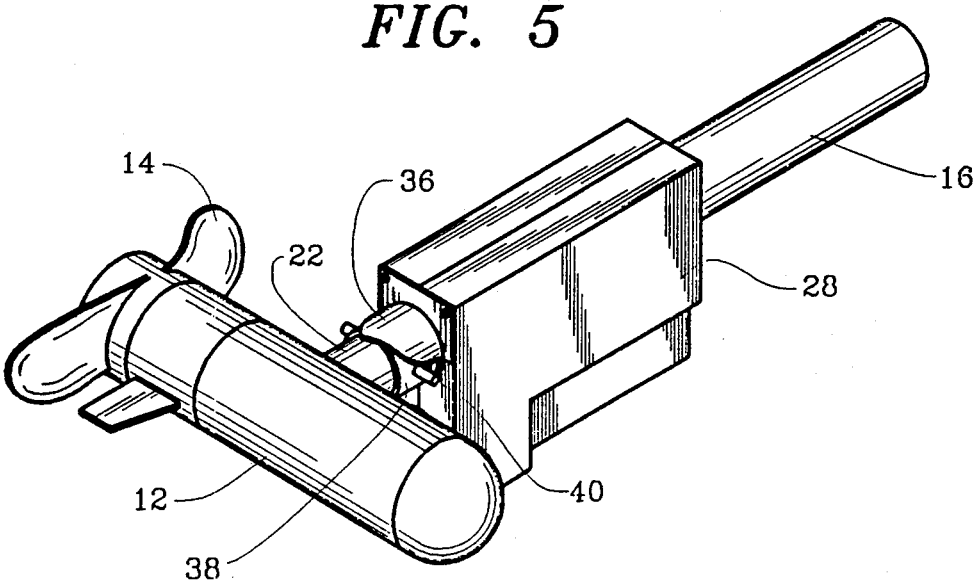

Referring to FIGS. 4 and 5, the secondary bracket 28 with the projecting cam 36 secured thereto is shown. A collar 38 is secured to the tube 22, and includes a pair of diametrically opposed pins 40 projecting from the collar 38. As the motor shaft 16 is raised along its longitudinal axis, one of the pins 40 will come into contact with the point of the cam 36. Further axial movement of the shaft will then cause the pin to move to one side or the other of the point, rotating the inner tube 22, so that the motor 12 comes to rest in the position shown in FIG. 5. Using a symmetrical pointed cam as shown will cause the motor to turn in either direction, and as is apparent, an asymmetrical pointing of the cam will cause the shaft to rotate in the same direction each time the shaft 16 is raised.

Figure 6:
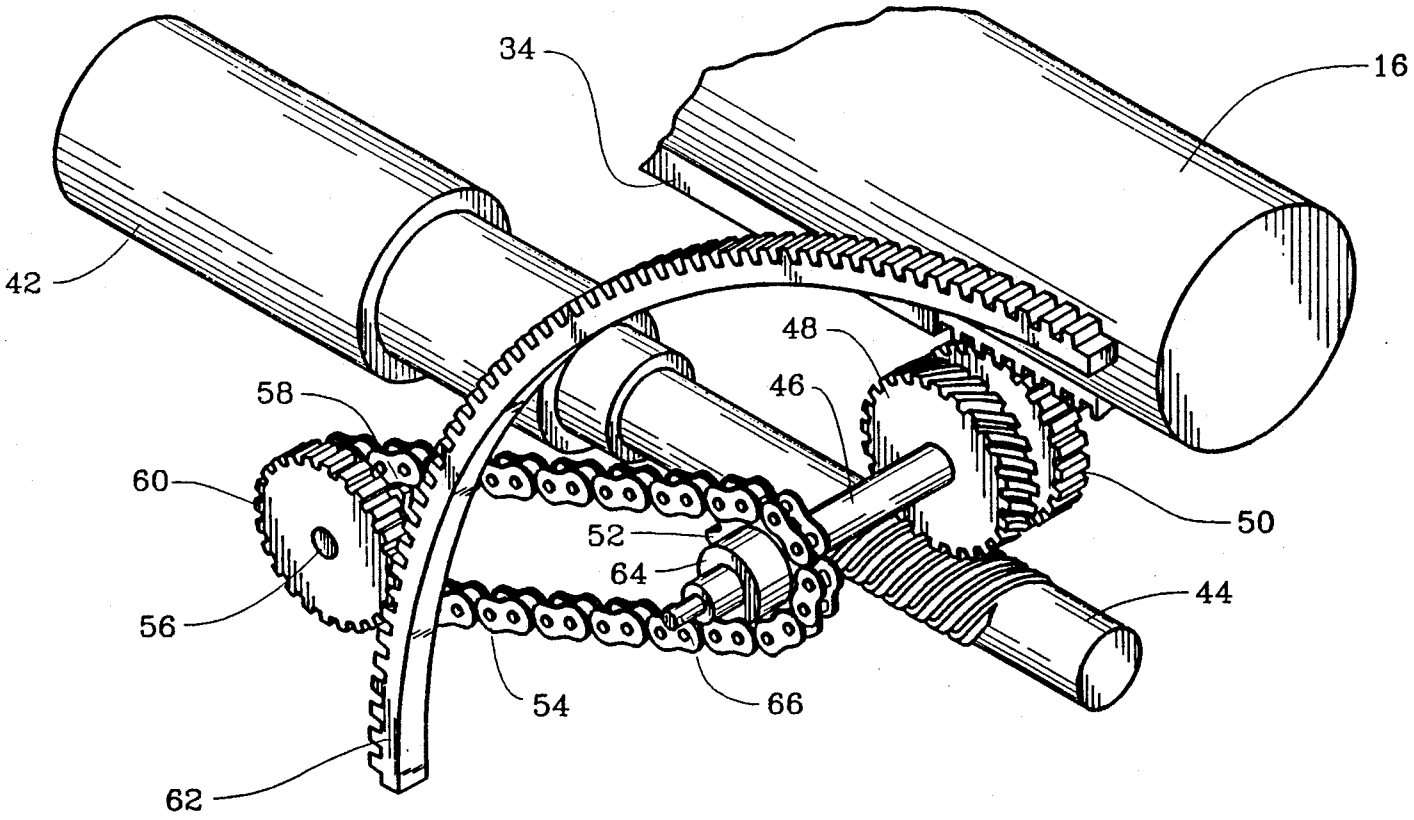
FIG. 6 is a schematic view of the driving mechanism for raising and lowering and pivoting the motor shaft.

FIG. 6 shows in greater detail the driving mechanism which is protectively housed within the primary bracket 24 and partially within bracket 28. A small, reversible electric motor 42, whose axis of rotation is in the same plane as the longitudinal axis of the supporting shaft 16, is supported in the secondary bracket 28 and positioned alongside the shaft 16. This motor may be controlled by a switch located, for example, on the dashboard of the boat, or on the front fishing platform of the boat, or both. A suitable switch may also be integrated into a combined control system for the motor, by which the electric propulsion motor may be remotely steered, as well as raised and lowered into the water.

The rotational output of the drive motor 42 is a worm shaft 44. A transfer shaft 46 is journalled in the secondary bracket 28, and a pinion gear 48 secured to the transfer shaft 46 is driven by the worm shaft 44. Also secured on the transfer shaft 46 for rotation therewith is a pinion gear 50 which meshes with the rack 34 mounted on the supporting shaft 16. In this manner, when the electric motor 42 is actuated, it causes the shaft 46 to rotate. The transfer shaft being secured in the secondary bracket 28, the motor supporting shaft 16 is caused to move axially with respect to the secondary bracket 28.

Also mounted on the transfer shaft 46 is a sprocket 52 which engages a chain 54. Another stub shaft 56 projects from the secondary bracket 28 and mounts a second sprocket 58 engaging the chain 54. A gear 60 is also secured to the shaft 56, and engages an arcuate rack gear 62 which is attached to the primary mounting bracket 24. In this manner, rotation of the transfer shaft 46 by the motor 42 causes the supporting shaft 16 to pivot about pivot pin 29.

Figure 3:
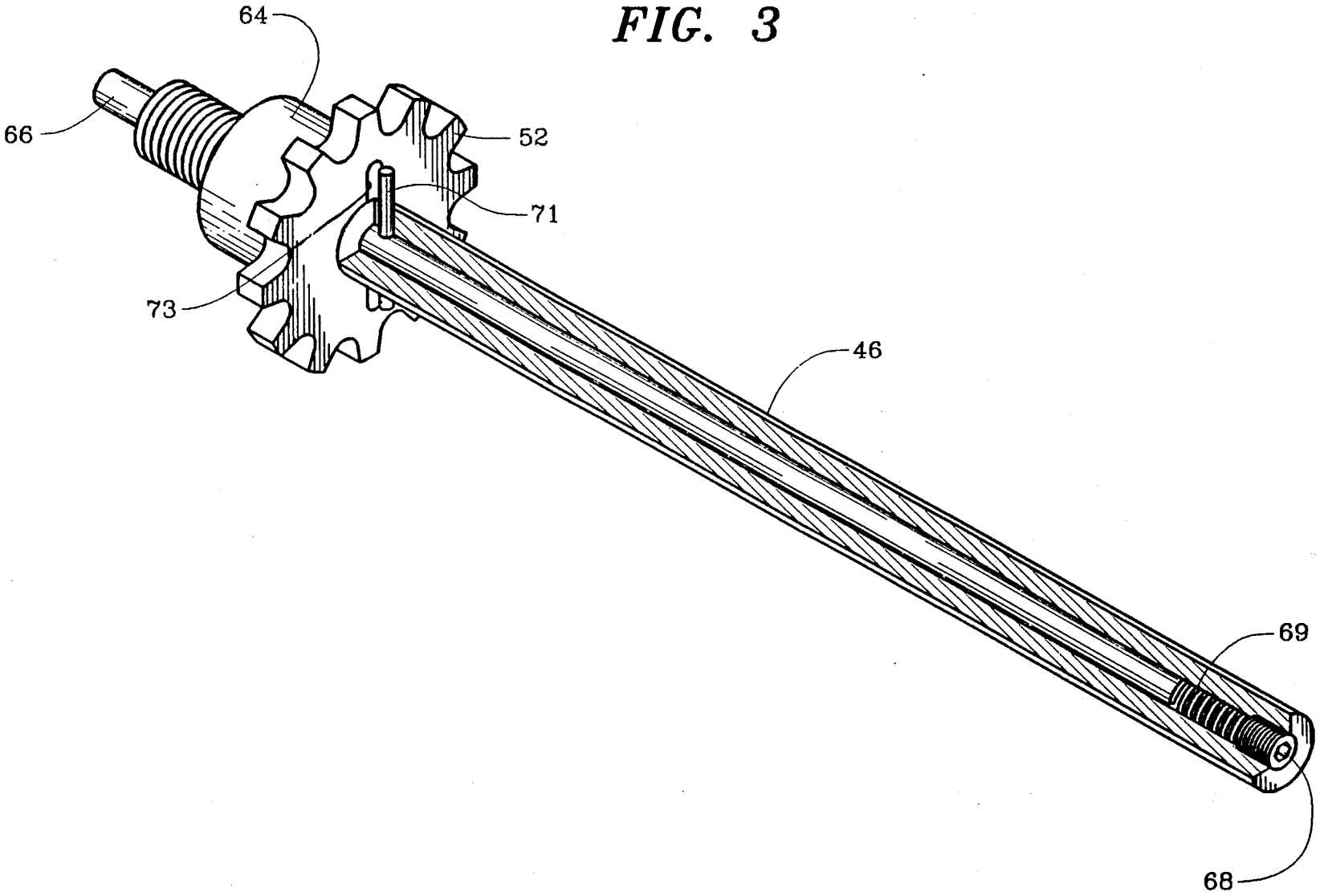
FIG. 3 is an enlarged fragmentary view of the transfer shaft and the drive clutch.

The transfer shaft 46 is threaded at one end so as to thread into a bushing 64 secured to the sprocket 52. As seen in FIG. 3, the transfer shaft is hollow and houses a rod 66 which is axially slidable in the shaft 46. A plug 68 is threaded into one end of the shaft 46 and serves as a stop for a spring 70 against which the rod 66 bears. A drive pin 72 is secured in the rod 66, and extends outwardly, so as to be engageable with elongate slots on either side of the shaft 46 in the drive sprocket 52. The drive pin 72 is of a length such that it can rest within diametrically opposed notches 74 formed in the sprocket 52, and is urged into such engagement by the spring 70. In this manner, when the drive pin engages the notches 74, the sprocket 52 and the chain 54 are driven. However, when the rod 66 moves axially, the drive pins 72 move out of the notches 74, stopping the driving of the chain 54, and thus stopping the pivoting of the motor supporting shaft 16 and the secondary bracket 28. The end of the rod 66 projects outwardly of the shaft 46 when the motor is in the stowed position, but upon lowering the motor to the operational position, a cam 67 in the housing 26 engages and depresses the rod 66, thereby disengaging the drive sprocket.

Figure 7:
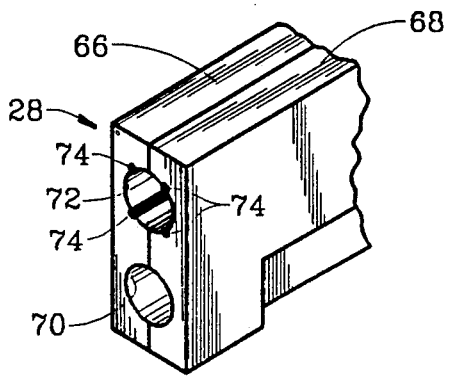
FIG. 7 is a perspective view of the secondary mounting bracket.

FIG. 7 shows a perspective view of the lower end of the secondary mounting bracket 28 which supports the outer tube 20 of the shaft 16 and the small electric motor 42. The bracket 28 may be cast, or machined, or even molded of metal or high strength composite plastic material. This bracket is formed of two halves 66, 68 secured together by bolts (not shown) as appropriate, with the motor 42 housed in a bore 70 therein. A second bore 72 supports the motor support shaft 16. The bracket does not actually contact the shaft 16. Rather, bearing surfaces are formed by preferably at least four rods 74 of nylon, Teflon, or similar plastic material housed in longitudinal grooves in the bracket. The use of such self-lubricating plastic rods allows for ease of movement of the supporting shaft, but also provides excellent support for the shaft to minimize movement of the shaft when the motor 12 is turned off and on. In addition, the support surfaces may be easily renewed by simply rotating the rods slightly in the bracket housing.

While this invention has been described as having certain preferred features and embodiments, it will be understood that it is capable of still further variation and modification without departing from the spirit of the invention, and this application is intended to cover any and all variations, modifications and adaptations of the invention as may fall within the spirit of the invention and the scope of the appended claims.

I claim:

1. An auxiliary outboard motor for boats comprising an electric propulsion motor having a propeller, a supporting shaft therefor and a first rack gear mounted thereon, means for mounting said supporting shaft onto a boat, said mounting means comprising a primary mounting bracket for fastening to a boat and a second rack gear secured thereto, a secondary mounting bracket pivotally connected to said primary bracket, said secondary mounting bracket including means for mounting said supporting shaft for longitudinal movement with respect to said secondary mounting bracket, a reversible electric drive motor for drivingly engaging said first and second rack gears for moving said supporting shaft longitudinally with respect to said secondary bracket and for pivoting said secondary bracket relative to said primary bracket, and means for disengaging said electric drive motor from said second rack gear after a predetermined longitudinal travel of said supporting shaft.

2. An auxiliary outboard motor for boats as in claim 1 and wherein said first rack gear is linear and said second rack gear is arcuate.

3. An auxiliary outboard motor for boats as in claim 1 and wherein said secondary mounting bracket comprises a frame having a first opening passing therethrough for supporting said supporting shaft therein, and a second opening for housing said drive motor.

4. An auxiliary outboard motor for boats as in claim 1 and wherein said secondary mounting bracket includes a projecting cam mounted thereon, pin means radially extending from said supporting shaft and engageable with said projecting cam, whereby upon longitudinal movement of said supporting shaft, said pin means contacts said projecting cam and causes said supporting shaft to rotate.

5. An auxiliary outboard motor for boats as in claim 3 and wherein said first opening comprises a cylindrical bore having self-lubricating bearing means for supporting said support shaft therein.

6. An auxiliary outboard motor for boats as in claim 5 and wherein said bearing means comprises a plurality of rods of bearing material lodged in recesses formed in said cylindrical bore at a depth such that the peripheral sides of said rods project slightly into said bore so as to contact and bear against said support shaft.

7. An auxiliary outboard motor for boats as in claim 6 and wherein said rods are formed of a self-lubricating plastic.

8. An auxiliary outboard motor for boats as in claim 7 and wherein said rods are formed of nylon.

9. An auxiliary outboard motor for boats as in claim 8 and wherein said secondary mounting bracket is formed of two cooperating halves.

10. An auxiliary outboard motor for boats as in claim 1 and wherein said drive motor drives a worm gear in engagement with a pinion gear mounted on a transfer shaft.

11. An auxiliary outboard motor for boats as in claim 10, and wherein said transfer shaft is journaled in said primary bracket and includes a second pinion gear in engagement with said first rack gear for causing an axial movement of said supporting shaft relative to said secondary mounting bracket.

12. An auxiliary outboard motor for boats as in claim 11 and including means for disengaging driving of said supporting shaft at a predetermined point.

13. An auxiliary outboard motor for boats as in claim 12 and wherein said disengaging means comprises a clutch.

14. An auxiliary outboard motor for boats as in claim 13 and wherein said clutch comprises a rod coaxially housed in said transfer shaft, and means for releasably securing said rod to said transfer shaft for rotation therewith.

15. An auxiliary outboard motor for boats comprising an electric propulsion motor having a propeller, a supporting shaft therefor with a first rack gear mounted thereon, means for mounting said supporting shaft onto a boat, said mounting means comprising a primary mounting bracket for fastening to a boat and having a second rack gear secured thereto, a secondary mounting bracket pivotally connected to said primary bracket, said secondary mounting bracket comprising a housing having bearing means for supporting said supporting shaft for longitudinal movement with respect to said secondary mounting bracket, a reversible electric drive motor housed in said secondary bracket and including means for drivingly engaging said first and second rack gears for moving said supporting shaft longitudinally with respect to said secondary bracket and for pivoting said secondary bracket relative to said primary bracket for moving said supporting shaft between an operative position and a stowed position, and means for disengaging said electric drive motor after a predetermined longitudinal travel of said supporting shaft.

* * * * *